United States Patent [19]

Rasmussen

[11] 4,323,522

[45] Apr. 6, 1982

[54] INTERNALLY VENTED FLOAT BOWL PRIMER ARRANGEMENT

[75] Inventor: Jerome L. Rasmussen, Timberline, Conn.

[73] Assignee: Tecumseh Products Company, Tecumseh, Mich.

[21] Appl. No.: 190,332

[22] Filed: Sep. 24, 1980

[51] Int. Cl.[3] ..... F02M 1/16

[52] U.S. Cl. ..... 261/72 R; 261/DIG. 8; 261/DIG. 67

[58] Field of Search ..... 261/DIG. 8, DIG. 67, 261/DIG. 68, 72 R, 73, 121 B

[56] References Cited

U.S. PATENT DOCUMENTS

| | | | |
|---|---|---|---|
| 1,752,959 | 4/1930 | Monier | 261/72 R |
| 3,001,774 | 9/1961 | Sarto | 261/72 R |
| 3,231,250 | 1/1966 | Kalert, Jr. | 261/72 R |
| 3,345,045 | 10/1967 | Tuggle | 261/DIG. 8 |
| 3,780,996 | 12/1973 | Nutten | 261/72 R |
| 3,968,189 | 7/1976 | Bier | 261/72 R |
| 4,203,405 | 5/1980 | Schultz et al. | 261/DIG. 8 |

FOREIGN PATENT DOCUMENTS

| | | | |
|---|---|---|---|
| 2316787 | 10/1974 | Fed. Rep. of Germany | 261/DIG. 67 |

OTHER PUBLICATIONS

Tecumseh Products Co. Mechanics Handbook, pp. 2-2-6; 2-3-4; and 2-4-1 through 2-4-3, 12/76.

"Lawn-Boy" Carburetor, as per sketch submitted Nov. 28, 1980 by Applicant.

*Primary Examiner*—Tim R. Miles

*Attorney, Agent, or Firm*—Albert L. Jeffers; Roger M. Rickert

[57] ABSTRACT

A manually actuable primer for an internally vented float regulated fuel bowl type carburetor employs an arrangement for minimizing variations in fuel mixture richness resulting from variations in air intake path restrictions as might be created by a clogged air filter includes a bifurcated float bowl air vent conduit with one branch communicating with the carburetor bore in the region of the Venturi and the other branch communicating with the bore outside the region of the Venturi along with an arrangement for directing displaced fuel from the fuel supply chamber directly into a conduit which normally conveys fuel from a fuel well to the Venturi region, the directing arrangement being formed as an annular insert for the fuel well, the aperture of which forms the fixed fuel metering orifice of the carburetor. With this arrangement primer actuation pressurizes the region above the fuel in the float bowl, forcing fuel through the annular member directly into the nozzle communicating between the fuel well and the carburetor bore Venturi, while the bifurcated float bowl air vent arrangement allows a smaller vent opening into the float bowl, making float bowl pressurization priming feasible, while minimizing mixture richness changes normally associated with air intake obstructions such as a dirty air filter.

3 Claims, 4 Drawing Figures

INTERNALLY VENTED FLOAT BOWL PRIMER ARRANGEMENT

BACKGROUND OF THE INVENTION

The present invention relates generally to carburetion systems for internal combustion engines and more particularly to a single control fixed fuel metering internally vented float bowl carburetor with enhanced priming capacity.

Small engine carburetors may be categorized as either of the diaphragm type where pressure differentials move a diaphragm to control fuel flow to the carburetor or of the float bowl type where a valve controlling float opens and closes to maintain a preferred fuel level in a fuel reservoir or chamber within the carburetor.

In one version of the float bowl type carburetor, fuel flows from this reservoir through a fuel metering orifice into a fuel well from which that fuel is sucked up and mixed with air due to the pressure differential caused by a Venturi region in the carburetor bore or throat. A proper fuel flow rate in this variety of carburetor is facilitated by venting the top of the float bowl to a constant pressure region. This venting may be to the atmosphere external of the carburetor or to a region of relatively constant pressure close to atmospheric pressure within the carburetor bore. The latter scheme is referred to as internal venting and has the advantage that the air supplied to the vent has already passed through the carburetor air filter and the likelihood that dirt will be introduced into the system causing difficulties such as the clogging of the fuel metering orifice is reduced.

Over a period of time, the engine intake air filter becomes dirty and clogged, so as to restrict air intake into the engine and to create a pressure drop across that air filter. With an externally vented float bowl, the effect of this restriction is to cause the engine to run on fuel rich mixture with the typical symptoms of loss of power, excessive carbon build-up in the combustion chamber and fouled spark plugs. The mixture becomes excessively rich because the pressure in the float bowl, forcing fuel through the metering orifice, remains at atmospheric pressure, so the rate at which fuel is supplied to the engine remains relatively fixed while the air intake restriction reduces the amount of air drawn into the engine, creating the unduly rich situation.

In an internally vented float bowl carburetor, the result of air intake restriction is to reduce the pressure within the float bowl and diminish the rate at which fuel is supplied to the engine with this effect being somewhat more pronounced than the decrease in combustion air being supplied to that engine so that the net result is an unduly lean mixture being supplied to the engine with the typical system of overheating of the engine. The smaller the air vent opening into the float bowl becomes, the more pronounced this leaning out effect due to air intake restriction becomes.

It is common practice to supply an initially fuel rich mixture to an internal combustion engine when attempting to start that engine. In addition to the conventional choke valve, several schemes for squirting fuel into the throat of the carburetor have been devised. An automatic arrangement for accomplishing this initial priming function is illustrated in U.S. Pat. No. 3,780,996 wherein when the engine is not running, a relatively small fuel well is filled to a certain level from the float bowl by way of the fuel metering orifice and when the engine is initially cranked, part of the fuel in this fuel well is forced into the carburetor throat and thereafter the engine runs with the fuel level in the well substantially lower than that fuel level was prior to initially cranking the engine. This system provides a fixed priming charge and works well so long as the environmental temperature range in which the engine is to be used is not excessive. For example, such an automatic priming scheme is well suited to lawnmower engine installations since the range of temperatures over which the average individual will mow a lawn is fairly limited. This patented system employed a single manual control member and a single fuel supply nozzle in conjunction with a fixed fuel metering orifice and represents a very simplistic and economical carburetion system. On the other hand, this patented system is certainly limited in the range of temperatures in which it may be employed and requires a short waiting period between attempts to start the engine in order to allow time for fuel to again fill the fuel well.

An improvement on the aforementioned U.S. Pat. No. 3,780,996 is illustrated in U.S. Pat. No. 4,203,405 wherein the advantages of the earlier patented device are retained while adding the capability of manual priming of the system. In this improvement, a flexible primer bulb may be depressed to increase the pressure on the surface of the fuel within the fuel well, forcing that fuel upwardly through a nozzle tube and into the throat of the carburetor. This later patented system may be operated in an automatic prime mode as with the earlier patented system, or preparatory to starting, the primer bulb may be depressed, forcing a first charge of fuel into the carburetor throat, and then, depending upon the time between primer actuation and starter actuation, a second at least partial fuel charge is introduced by the automatic priming aspect when the engine is cranked. Both of these patented systems require a time lag between priming attempts in order to allow time for fuel to re-enter the fuel well through the metering orifice. Thus, the priming capacity of this later patented device remains somewhat more limited than desired.

SUMMARY OF THE INVENTION

Among the several objects of the present invention may be noted the provision of an internally vented float bowl carburetor having a relatively constant fuel mixture richness despite air intake restriction variations, as might for example be created by a dirty-clogged air filter; the provision of an operator actuable fuel primer of increased capacity; the provision of an operator actuable fuel primer requiring substantially no waiting period between successive actuations; the provision of a carburetor which automatically provides a small priming fuel charge to an engine when that engine is cranked and is capable of providing repeated additional priming charges upon manual actuation of a primer bulb; and the provision of an internally vented float bowl type carburetor having a substantially reduced size vent opening into the float bowl. These as well as other objects and advantageous features of the present invention will be in part apparent and in part pointed out hereinafter.

In general and in one form of the invention, the entire region above the fuel in the float bowl is pressurized upon actuation of a primer bulb. The bowl vent opening is reduced substantially as compared to prior venting arrangements so that this pressurization may occur. The fuel-air mixture problems which might otherwise be accentuated by this small bowl vent opening are compensated for by connecting the bowl vent opening to the Venturi region of the carburetor bore as well as to a region outside the Venturi region. The effectiveness of the primer operation is enhanced by providing an annular insert which functions both as the fuel metering orifice and upon primer actuation functions to direct the prime charge upwardly through the tube leading from the fuel well to the carburetor throat.

Also in general and in one form of the invention, a single control fixed fuel metering carburetor for providing a combustible fuel air mixture through the bore thereof to a conventionally aspirated internal combustion engine has a restricted Venturi region along with a float regulated fuel supply chamber and a fuel well which is gravity fed from the float regulated chamber along with a conduit arrangement for conveying fuel from the fuel well to air passing through the carburetor bore in the region of the Venturi. A bifurcated fuel supply chamber air vent conduit with one branch thereof communicating with the bore in the region of the Venturi and another branch thereof communicating with the bore outside the region of the Venturi maintains the air pressure within the chamber relatively constant despite variations in restricting the amount of air entering the carburetor. The fuel flow metering orifice may be aligned with this conduit and a manually actuable primer employed to increase the air pressure within the fuel supply chamber thereby displacing fuel from that chamber through the fuel flow metering orifice and directly into the conduit.

BRIEF DESCRIPTION OF THE DRAWING

Corresponding reference characters indicate corresponding parts throughout the several views of the drawing.

Figure 1:
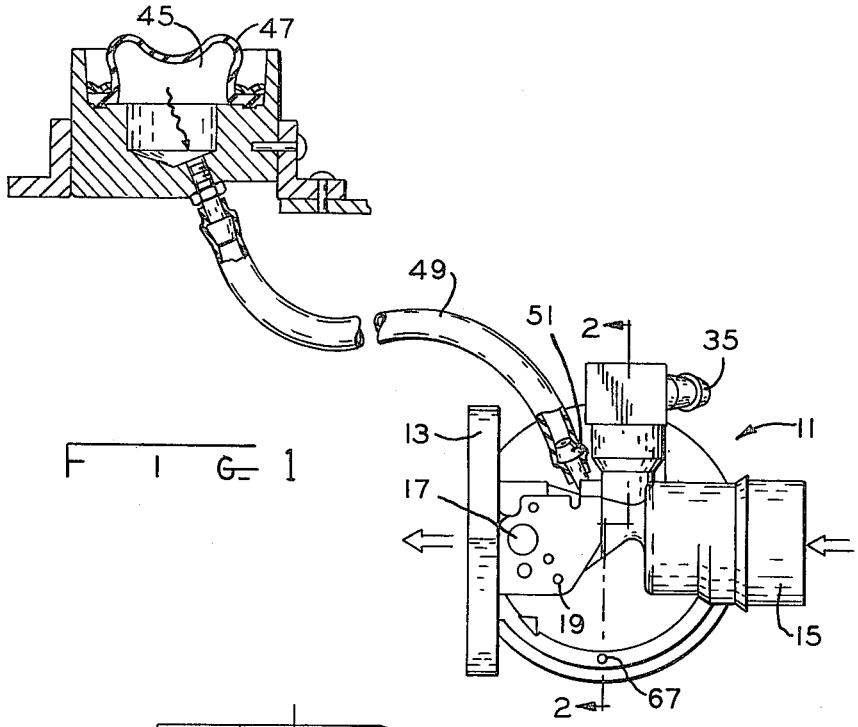
FIG. 1 is a top view of a carburetor with the pliable dome primer thereof located remote from the carburetor and illustrated in cross-section.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Referring now to the drawings in general, a carburetor 11 provides a combustible fuel air mixture to a conventionally aspirated internal combustion engine having, for example, flange 13 bolted either directly to the engine or to an intake manifold thereof. Air is supplied to the carburetor through an air filter which attaches to surface 15 on the air inlet side of the carburetor. Air flows through the carburetor in the direction illustrated by the arrows in FIG. 1. The carburetor has a single control in the form of a conventional butterfly valve attached to rod 17 and movable by actuating arm 19 between positions where the carburetor bore 21 is nearly closed and where that bore is substantially unobstructed by the butterfly valve. This valve constitutes the sole variable air restrictor in the carburetor bore. Fuel metering for the carburetor is also fixed by the size of the aperture through the annular insert 23 with this opening constituting the fuel metering orifice of the carburetor.

Figure 2:
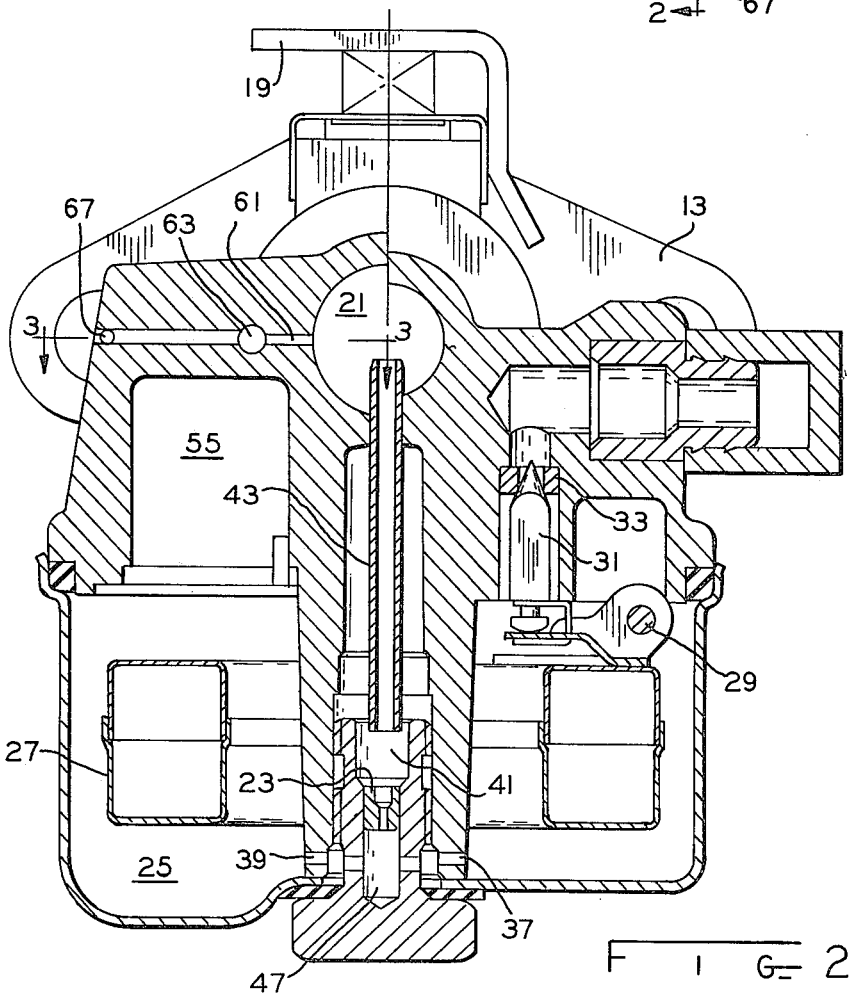
FIG. 2 is a view in section along line 2—2 of FIG. 1.

Referring primarily to FIG. 2, the carburetor has a float regulated fuel supply chamber 25 of conventional construction with an annular float 27 pivoted at 29 and controlling needle 31 with respect to seat 33 to open the valve defined by the needle and seat and allow fuel to enter the float regulated chamber or bowl 25 when the level of that fuel drops sufficiently to open the valve. Thus, fuel is supplied to the carburetor by way of a fuel line attached to fitting 35.

Fuel in the fuel supply chamber 25 passes through openings, such as 37 and 39, into region 41 and then upwardly through the annular insert 23 into a fuel well 41 to thereafter be aspirated by way of nozzle tube 43 into the Venturi region of the carburetor bore during normal engine operation. Fuel well 41 is thus gravity fed from the float regulated chamber 25 with nozzle tube 43 constituting a conduit for conveying fuel from the well 41 to air passing through the carburetor and into the engine during normal engine operation.

An air filled variable volume chamber 45 of FIG. 1 is actuable by an operator by depressing the pliable dome 47 from its normal position to the position of the pliable dome 47 illustrated to abruptly displace a discrete volume of air from that variable volume chamber by way of hose 49 and fitting 51 through opening 53 and into region 55 in the fuel supply chamber 25. Thus, tube 49 and fitting 51 along with opening 53 form a part of a passageway interconnecting the variable volume chamber 45 to the fuel supply chamber 25 with a decrease in the volume of the variable volume chamber 45 forcing air into the fuel supply chamber 25. This air displacement in turn displaces fuel from the fuel supply chamber 25 by way of openings 37 and 39 upwardly through the orifice of annular insert 23 so that the fuel is directly aligned with or guided into nozzle 43 to squirt upwardly into the carburetor bore or throat. The annular insert 23 is located within fuel well 41 displaced from and axially aligned with the conduit 43 so as to direct the displaced fuel from the fuel supply chamber 25 directly into the cylindrical nozzle 43.

Figure 3:
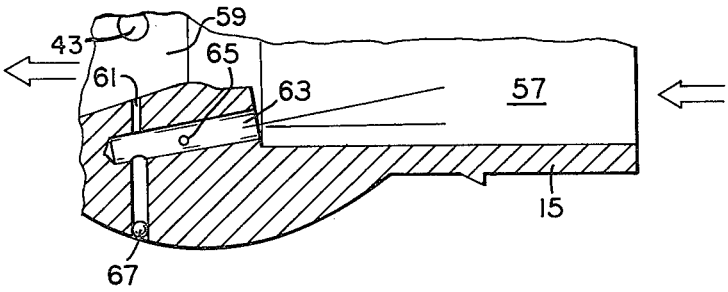
FIG. 3 is a view in cross-section along line 3—3 of FIG. 2.

Air flow through the carburetor throat is from right to left, as illustrated by the arrows in FIGS. 1 and 3, with that air flowing initially into the carburetor bore 57 and continuing into the restricted Venturi region 59 where the pressure differential between regions 59 and 57 forces fuel mixed with air upwardly through nozzle 43 to be mixed with the air flowing through the carburetor bore and pass into the engine.

Figure 4:
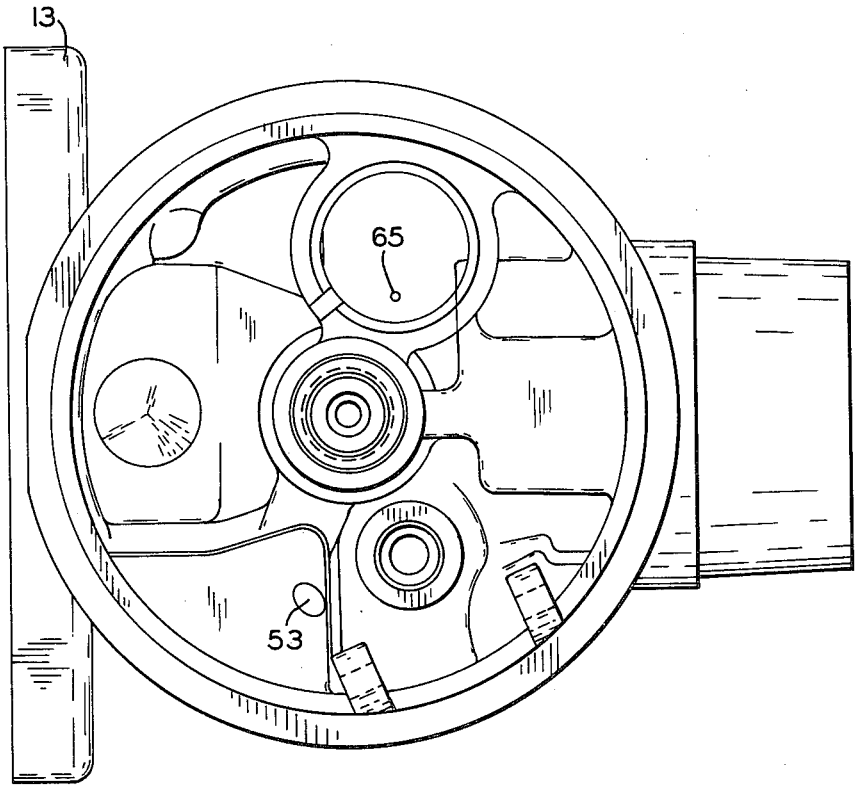
FIG. 4 is a bottom view of the carburetor of FIG. 1 with the float bowl and float thereof removed.

To minimize variations in fuel mixture richness resulting from variations in air intake path restrictions, such as a buildup of dirt in the air filter, an internal venting effect into the Venturi is provided which acts as a balancing or stabilizing factor minimizing these variations. This internal venting of the float bowl into the Venturi region is provided by a bifurcated float bowl air vent conduit having three branches, as perhaps best seen in FIG. 3. One branch 61 communicates with the carburetor bore in the Venturi region 59, while another branch 63 communicates with the bore outside the region of the Venturi. Thus, there is the normal Venturi induced pressure differential between these two outlets. The third branch is a small hole 65 extending from the hole 63 directly downwardly and opening into the upper region of the float bowl, as illustrated in FIG. 4. This air vent conduit then is seen to comprise three generally cylindrical holes formed in the body portion of the carburetor with hole 63 being the first and larger of the holes and being formed as a blind hole opening into the carburetor bore 57 outside the Venturi region. The hole 61 is the second and next largest of these cylindrical holes and also constitutes a blind hole extending transverse to and intersecting the first hole 63 while opening into the Venturi region 59 of the bore. In practice, hole 61 is drilled into the carburetor body portion and then plugged by ball 67 so as to form a blind hole. Hole 65 which opens into the carburetor float bowl is the smallest of the three holes and extends from an upper surface of the fuel supply chamber so as to intersect the first hole 63.

In order that actuation of the primer bulb 47 will force a priming charge of fuel into the carburetor bore, hole 65 must be relatively small, and by way of illustration this hole was in one embodiment of the present invention about 24/1000ths of an inch in diameter. The fuel metering aperture in annular member 23 was about the same size as the opening of the air vent conduit 65 into the fuel supply chamber while the diameter of the Venturi region conduit opening was half again the diameter of the float bowl opening, and the diameter of the bore opening 63 was on the order of four times the diameter of the float bowl opening. With these dimensions, adequate priming and minimum mixture richness variations were obtained.

A preferred embodiment of the invention as above described was otherwise constructed and functions much the same as the carburetor described in the aforementioned U.S. Pat. Nos. 3,780,996 and 4,203,405 to which reference may be had for additional conventional details of the carburetor.

From the foregoing it is now apparent that a novel process for supplying a priming charge of fuel to an internal combustion engine as well as a novel arrangement for venting the float bowl so as to minimize mixture richness variations has been disclosed meeting the objects and advantageous features set out hereinbefore as well as others and that modifications as to the precise configurations, shapes and details may be made by those having ordinary skill in the art without departing from the spirit of the invention or the scope thereof as set out by the claims which follow.

What is claimed is:

1. A single control fixed fuel metering carburetor for providing a combustible fuel-air mixture to a conventionally aspirated internal combustion engine comprising:

a carburetor bore forming part of the engine air intake path and having a restricted Venturi region therein;

a float regulated fuel supply chamber;

a fuel well gravity fed from the float regulated chamber;

conduit means for conveying fuel from the fuel well to air passing through the carburetor bore in the region of the Venturi; and a bifurcated fuel supply chamber air vent conduit having one branch communicating with the bore in the region of the Venturi and another branch communicating with the bore outside the region of the Venturi formed in a body portion of the carburetor as three generally cylindrical holes, the first and largest of which is a blind hole opening into the bore outside the Venturi region, the second and next largest of which is also a blind hole transverse to and intersecting the first hole and opening into the Venturi region of the bore, and the third and smallest of which extends from an upper surface of the fuel supply chamber to intersect the first hole.

2. The carburetor of claim 1 further comprising an annular member disposed within the fuel well displaced from and aligned with the conduit means, the annular member aperture forming the fuel flow metering orifice of the carburetor.

3. The carburetor of claim 2 further comprising a manually actuable primer for selectively increasing the air pressure within the fuel supply chamber to displace fuel therefrom through the fuel flow metering orifice and directly into the conduit means.

* * * * *